United States Patent [19]

Tillman

[11] Patent Number: 4,938,347

[45] Date of Patent: Jul. 3, 1990

[54] DISPOSABLE SINGLE DIGIT NAIL POLISH REMOVER POUCH

[75] Inventor: Cynthia A. Tillman, Alexandria, Va.

[73] Assignee: PKP, Inc., Alexandria, Va.

[21] Appl. No.: 289,000

[22] Filed: Dec. 23, 1988

[51] Int. Cl.[5] ..... B65D 75/00

[52] U.S. Cl. ..... 206/209; 206/361; 206/812; 206/823; 132/75

[58] Field of Search ..... 132/73, 73.5, 74.5, 132/75, 333; 206/209, 210, 229, 361, 484, 581, 610, 620, 627, 629, 812, 823, 205; 604/289, 292, 293

[56] References Cited

U.S. PATENT DOCUMENTS

| | | | |
|---|---|---|---|
| 2,103,389 | 12/1937 | Salfisberg | 206/629 |
| 2,980,940 | 4/1961 | Crowe | 206/484 |
| 3,005,543 | 10/1961 | Morse | 132/73 |
| 3,014,579 | 12/1961 | Lathrop | 132/73 |
| 3,124,825 | 3/1964 | Iovenko | 15/104.93 |
| 3,657,760 | 4/1972 | Kudisch | 206/484 |
| 3,902,509 | 9/1975 | Tundermann et al. | 206/229 |
| 4,116,338 | 9/1978 | Weichselbaum | 206/610 |
| 4,671,306 | 6/1987 | Spector | 132/73 |
| 4,800,904 | 1/1989 | Kinseley et al. | 132/73.5 |

*Primary Examiner*—Jimmy G. Foster

*Attorney, Agent, or Firm*—Venable, Baetjer, Howard & Civiletti

[57] ABSTRACT

A disposable, readily portable pouch containing a dauber moistened with a nail polish removing solvent sufficient to remove polish from a single fingernail or toenail is disclosed. The pouch has a generally flattened configuration which, when opened, can comfortably accommodate a single human digit to at least the first joint for the purpose of removing nail polish from the nail.

18 Claims, 3 Drawing Sheets

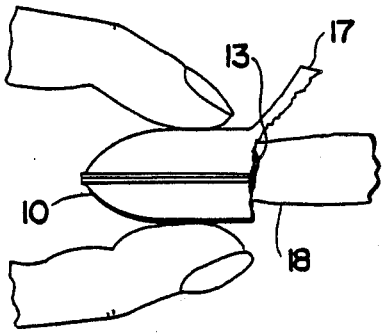
Fig. 4
Fig. 5
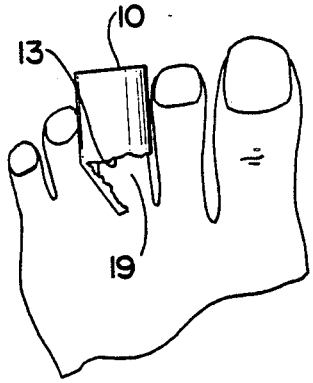

DISPOSABLE SINGLE DIGIT NAIL POLISH REMOVER POUCH

BACKGROUND OF THE INVENTION

1. Field of the Invention

The present invention relates generally to methods and devices for removing nail polish, and particularly to methods and devices in which absorbent material is contained in a disposable package.

The present invention is described in detail below as relating to an acetone containing device for removal of enamel nail polish and the like. However, it will be understood that the invention encompasses use of a solvent other than acetone for purposes of removal of various nail polishes and other decorative materials.

2. Description of the Related Art

The present invention relates to disposable devices for removing nail polish from fingernails or toenails. Numerous products on the market are tailored to routine manicures and pedicures in the home or salon. A nail polish removing solvent contained in a bottle may be poured onto a cotton swab or cloth grasped by the fingers of one hand to remove nail polish from one or more fingernails of the other hand, or from toenails. The nature of nail polish is such that its efficient removal from the nail surface requires that the polished nail be exposed to the solvent and then rubbed or massaged with a textured surface to remove all traces of polish. However, the use of nail polish remover in this manner is disadvantageous because the solvent will remove nail polish from the nails of fingers that hold the cotton swab or cloth as well as from the nails to which the solvent is directed. Solvent may also be contained in an absorbent pad. A holder adapted to receive the pad may prevent removal of nail polish from the nails of the fingers which are manipulating the holder. However, the holder will not prevent inadvertent removal of nail polish from adjacent nails of the other hand. Similarly, a package containing a swab and solvent may be adapted to be opened so that the swab is exposed. The fingers of a hand holding the package may be protected from exposure to the swab while manipulating the package to remove nail polish from fingernails of the other hand, or from toenails. Such a device also cannot prevent inadvertent removal of nail polish from nails adjacent to the one from which it is removed.

A jar or thimble may be adapted with an absorbent foam sponge or felt material which is saturated with solvent. Such a device may be used to remove nail polish from several fingernails individually by sliding the fingernail between two layers of absorbent material in the jar. The container is then rotated around the nail, thus removing the polish. Although the majority of these types of products are marketed for use on toenails as well as fingernails, in practice, removing polish from a toenail with one of these products is difficult if not impossible due to the configuration of the container and the anatomy of the human foot. Such a device has at least two inherent disadvantages. Like the bottle of solvent, the device carries a considerable amount of solvent which is both volatile and flammable. The jar is rigid and bulky. Being volatile and flammable, the solvent is dangerous to use in unventilated spaces or close to a flame. The jar containing solvent also cannot be stored at temperatures well above room temperature or at low pressure such as in the luggage compartment of an aircratft. Because the jar is rigid and bulky, the jar does not lend itself to being transported in a purse or other luggage or to being used in a moving vehicle.

An efficient portable nail polish remover device should embody several attributes: (1) Portability or ease of carrying on one's person or in one's belongings; (2) minimum of flammable solvent so that the safety harzard is reduced; (3) means for maintaining the integrity of the device containing the solvent so that leakage does not occur; (4) means for delivering the solvent which allows the treatment of one nail without disturbing the polish on other nails and which reduces the opportunity for spillage of the solvent on one's person or belongings; and (5) ease of disposal after use.

Accordingly, it is an object of the present invention to provide a means for non-rountine or emergency removal of nail polish from a single fingernail or toenail without disturbing the polish on other digits.

It is another object to provide the user with a means for removing nail polish that requires a minimum of solvent, thus minimizing the safety hazard associated with solvent storage.

A further object to provide a means for storing nail polish solvent in a manner that is easily transportable and which will prevent leakage of the solvent when the device is not in use.

Yet a further object to provide a one-piece means for removing nail polish that is easily disposable after use.

SUMMARY OF THE INVENTION

Briefly stated, these objects are attained in a disposable nail polish removing pouch which is flat and flexible so that it may be easily stored in a person's luggage, purse, desk or the like. The pouch contains an absorbent, textured dauber attached to at least one inner wall of the pouch. The dauber is permeated with an acetone-containing solvent in sufficient quantity to remove nail polish from at least one fingernail or toenail. Upon opening the pouch along a seal line, at least one human digit can be inserted up to about the first joint. A damaged manicure can be repaired by removing the nail polish from the nail of the digit. Removal is easily accomplished by rubbing the nail against the solvent-containing dauber. Once polish removal has been accomplished, the pouch can be discarded, and replacement nail polish can be applied to the nail.

The pouch of the present invention has the following advantages: The pouch can be used to remove nail polish from a single fingernail or toenail between manicures and pedicures without exposing other fingernails to solvent: The pouch is easily stored in a purse, automobile glove box, luggage, desk, or the like because the pouch is flat, small and flexible. The pouch contains a non-removable dauber, so that the danger of damage to clothing, leather or wood finishes from exposure to the solvent is minimized. The pouch contains only a small quantity of solvent, so that danger of accidental fires is minimized. The pouch is sealed so that danger from leakage or evaporation of the solvent at high temperature or low atmospheric pressures is minimized.

BRIEF DESCRIPTION OF THE DRAWINGS

FIG. 4 is a side, sectional view illustrating the nail polish remover pouch of the present invention in use on a fingernail; and FIG. 5 is a top view of the nail polish remover pouch in place on a toenail.

DETAILED DESCRIPTION OF THE PREFERRED EMBODIMENTS

In order to provide a clear and consistent understanding of the specification and the claims, including the scope given to such terms, the following definitions are provided:

"Absorbent" means taking up and retaining a nail polish solvent.

"Dauber" means a piece, chunck or pad of absorbent material that is the shape of the pouch interior and which does not extend beyond the periphery of the solvent retaining cavity into the permanently sealed periphery of the pouch.

"Fluid" means a mixture which contains a nail polish removing solvent.

"Impervious" means incapable of permitting the passage of nail polish solvents and unaffected by the presence of nail polish solvents or any of their component parts.

"Manicure" refers to treatment of the fingernails with chemical solutions and to the mechanical manipulation of said nails for purposes of personal hygiene and health. Most particularly, "manicure" refers to removal of nail polish by means of chemical solvents, filing of the nails with pumice or the like, and application of nail polish of the nails.

"Nail enamel", "Nail lacquer", and "Nail polish" mean a chemical or chemical compound which, when applied to the surface of a fingernail or toenail, dries to form a dense, hard coating on the nail surface and which can be readily removed by a solvent.

"Pedicure" refers to the activities described in the definition of "manicure", with the exception that the activities are performed on the toenails.

"Permanent seal" means a closure which is intended to remain intact until opened and which, when opened, may not be restored to its original state.

"Pouch" means a small, flat, closed bag, sack or like container which may be carried or transported on one's person or in one's belongings and which requires a minimum of space for such carriage or transport.

"Solvent" means a substance in any physical form which dissolves or is capable of dissolving nail enamel, nail lacquer or nail polish.

Figure 1:
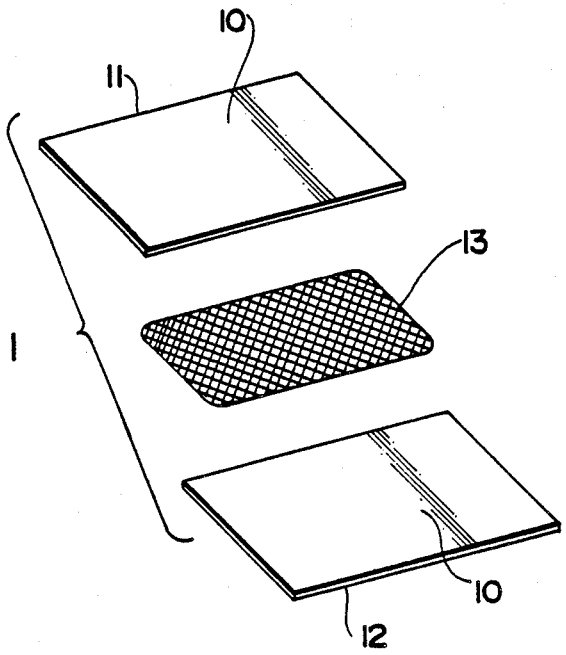
FIG. 1 is an exploded view of a nail polish remover pouch as in accordance with the present invention.

Referring to the drawings wherein like reference characters designate identical or corresponding parts throughout the several views, there is shown in FIG. 1 an exploded view of a nail polish remover pouch 10. The pouch is comprised of a top sheet 11 and a bottom sheet 12 of solvent imprevious material, and a solvent absorbent dauber 13 which is permanently coupled to an inside surface of at least one of the sheets 11 and 12. It should be understood that sheets 11 and 12 represent top and bottom portions of the pouch 10. It is therefore within the scope of the invention to form a pouch from a single sheet of solvent imprevious material folded once on itself to form a top portion 11 and a bottom portion 12.

The solvent absorbent dauber 13 is comprised of an appropriate material that is absorbent and has a sufficient texture to provide a scrubbing action to assist the solvent in removing nail polish from a nail. Such materials include, but are not limited to, flexible foam plastic material such as polyurethane, cotton webbing or felt which are non-reactive with the solvent permeating the dauber. The dauber is preferably permanently attached to the inside surface of only one of the sheets 11 and 12 by heat sealing, sonic welding, gluing, cementing, bonding or other suitable means.

Figure 2:
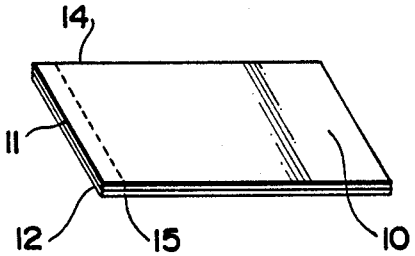
FIG. 2 is a perspective view of an unopened nail polish remover pouch of the type depicted in FIG. 1.

Referring now to FIG. 2, the pouch is shown with the top sheet 11 and the bottom sheet 12 placed together in parallel overlying relationship to each other to form the pouch 10. The sheets 11 and 12 can be bonded together along their edge 14 by any suitable means known in the art. Such means include, but are not limited, to heat sealing, sonic welding, gluing, cementing, bonding or the like. Whatever bonding method is used must result in a seal that is inert to the solvent absorbed on the dauber to maintain the fluid imperviousness of the pouch.

The solvent that permeates the dauber is any one that is suitable for dissolving any nail polish. Typically, a solvent mixture containing acetone as the primary solvent is used. The acetone may be in a mixture with water, fragrance, a skin moisturizer or other substances suitable for cosmetic purposes.

The solvent mixture can be applied to the dauber 13 before the sheets 11 and 12 are placed together and sealed. Alternatively, the sheets 11 and 12 may be partially sealed and the solvent mixture placed on the dauber 13 immediately before the edge seal is completed.

Figure 3:
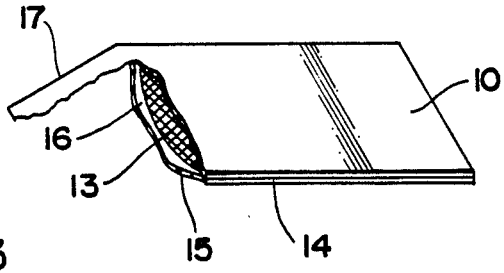
FIG. 3 is a perspective view of a partially opened nail polish remover pouch of the type depicted in FIGS. 1 and 2, ready for use.

The sealed pouch 10 can be constructed with a notch 15, tear strip 15 or other means of assisting the user to open the pouch along the edge 14 in a straight line. FIG. 3 shows the pouch 10 having the seal torn away at the notch 15 to reveal the dauber 13, which is in a fluid-retaining cavity 16 and attached to the inside surface of only one of the sheets 11 and 12. A flap 17 may remain attached to the open pouch 10 as the user may find convenient.

The notch or tear strip 15, which can begin as a slit or "V"-shaped cut, is situated partially through the permanently sealed edge 14 of the pouch 10. The tear strip 15 serves to provided direction to a tearing force applied to open the pouch. Following application of a tearing force along tear strip 15, the user then squeezes the two parallel seams adjacent the longitudinal edges 14 to form an opening for insertion of a digit. The pouch can comfortably accommodate the insertion of one human digit to approximately the first joint.

After the pouch 10 is opened, the user, as shown in FIGS. 4 and 5, then inserts a finger 18 or toe 19, having a nail whose polish is to be removed into the open pouch 10 so that the nail is placed against the solvent containing dauber 13. A massaging motion of the textured dauber across the nail is used to assist the solvent to dissolve the nail polish, and to wipe solvent and polish away. The user then withdraws the digit from the pouch and disposes of the pouch. The nail is now ready for application of new polish.

A pouch such as the one described above is ideally suited for removal of polish from a single nail where the manicure is in need of repair.

While the invention has been described in connection with specific embodiments thereof, it will be understood that is capable of further modifications. This application is intended to cover any variations, uses or adaptations of the invention following, in general, the principles of the invention and including such departures from the present disclosure as come within known and customary practice within the art to which the invention pertains.

What is claimed is:

1. A combined fluid storage and application device, comprising:
   (a) two superposed sheets of fluid impervious material positioned in a generally flat, parallel overlying relation to each other;
   (b) seal means for sealing said sheets to each other;
   (c) a fluid-retaining cavity having substantially flat parallel opposed wall surfaces formed by said sheets, a permanent seal line defining the periphery of said fluid retaining cavity;
   (d) a fluid-retaining dauber disposed in said cavity and coupled to only one of said wall surfaces; and
   (e) a fluid comprising a nail polish solvent contained within said dauber.

2. The device of claim 1, wherein said seal means comprises a thermal seal.

3. The device of claim 1, wherein said fluid impervious material is comprised of foil.

4. The device of claim 1, wherein said fluid comprises acetone or an acetone-containing mixture.

5. The device of claim 1, wherein said seal means is formed from a sonic weld.

6. The device of claim 1, wherein said fluid impervious material is a plastic.

7. The device of claim 1, further comprising a tear strip for providing directional guidance to a tearing force selectively applied to open said device.

8. The device of claim 1, further comprising a notch for providing directional guidance to a tearing force selectively applied to open said device.

9. A combined fluid storage and application device, comprising:
   (a) a single integral sheet of fluid impervious material folded along a fold line to form generally symmetrical sheet halves positioned in a generally flat, parallel, overlying relation to each other;
   (b) seal means for sealing said sheet halves to each other along a seal line extending from the fold line;
   (c) a fluid retaining cavity having substantially flat, parallel, opposed wall surfaces formed by said sheet halves, said fold line and said seal line cooperating to define the periphery of said fluid retaining cavity;
   (d) a fluid-retaining dauber disposed in said cavity and coupled to only one of said wall surfaces; and
   (e) a fluid comprising a solvent for nail polish, said fluid being contained within said dauber.

10. The device of claim 9, wherein said seal means comprises a thermal seal.

11. The device of claim 9, wherein said dauber comprises an acetone-absorbent material.

12. The device of claim 9, wherein said fluid impervious material is comprised of foil.

13. The device of claim 9, wherein said fluid comprises acetone or an acetone-containing solution.

14. The device of claim 9, wherein the fluid impervious material is a plastic.

15. The device of claim 9, further comprising a tear strip for providing directional guidance to a tearing force selectively applied to open said device.

16. The device of claim 9, further comprising a notch for providing directional guidance to a tearing force selectively applied to open said device.

17. A combined fluid storage and application device; comprising:
   (a) pouch formed of a fluid impervious material, said pouch defining a fluid-retaining cavity having substantially flat parallel opposed wall surfaces formed by the pouch;
   (b) a permanent seal line defining the periphery of said fluid retaining cavity;
   (c) a fluid-retaining dauber disposed in said cavity, said dauber having first and second opposing surfaces, the first surface being permanently attached to only one of said wall surfaces;
   (d) a fluid comprising a nail polish remover contained within said dauber; and
   (e) and opening means for opening said device along one edge of the pouch.

18. A combined fluid storage and application device, comprising:
   (a) a sealed pouch sealed along its edges and having a rupturable seal means along one edge;
   (b) said pouch defining a fluid-retaining cavity capable of allowing entry of a single digit, into the interior of the pouch, said fluid-retaining cavity having substantially flat, parallel, opposing wall surfaces formed by said pouch;
   (c) a fluid-retaining dauber disposed within said cavity, said dauber having first and second opposing surfaces, said first surface being permanently attached to only one inner wall surface, said second surface being exposable to the nail of said digit upon entry of said digit, said
   (d) a fluid comprising a nail polish remover contained within said dauber.

* * * * *

UNITED STATES PATENT AND TRADEMARK OFFICE

CERTIFICATE OF CORRECTION

PATENT NO. : 4,938,347

DATED : July 3, 1990

INVENTOR(S) : Cynthia A. Tillman

It is certified that error appears in the above-identified patent and that said Letters Patent is hereby corrected as shown below:

at Column 2, line 16 after "non -" delete [rountine] and insert -- routine --.

at Column 2, line 23 after "object" add -- is --.

at column 3, line 18 after "piece," delete [chunck] and insert -- chunk --.

at column 3, line 66 after "solvent" delete [imprevious] and insert -- impervious --.

at column 4, line 17 after "limited" delete [,] and after "to" insert -- , --.

at column 6, line 35 delete [and].

Signed and Sealed this

First Day of October, 1991

*Attest:*

*Attesting Officer*

HARRY F. MANBECK, JR.

*Commissioner of Patents and Trademarks*